US007214434B2

(12) United States Patent
Dalgleish et al.

(10) Patent No.: US 7,214,434 B2
(45) Date of Patent: May 8, 2007

(54) PAPER AND PAPERBEAD FOR PROTECTING DRYWALL CORNERS

(75) Inventors: Donald C. Dalgleish, Edmonton (CA); Garry K. Mix, Edmonton (CA); Robert K. Williams, Sherwood Park (CA)

(73) Assignee: Bailey Metal Products Limited, Concord, ON (CA)

( * ) Notice: Subject to any disclaimer, the term of this patent is extended or adjusted under 35 U.S.C. 154(b) by 312 days.

(21) Appl. No.: 10/462,799

(22) Filed: Jun. 17, 2003

(65) Prior Publication Data

US 2004/0255537 A1 Dec. 23, 2004

(51) Int. Cl.
*B32B 29/00* (2006.01)

(52) U.S. Cl. ..... 428/537.5; 162/164.1

(58) Field of Classification Search ..... 52/254, 52/255, 506.1, 287.1, 256; 156/42, 43, 153, 156/71; 428/537.5, 219, 411.1; 524/47; 162/135, 136, 137, 124, 184, 204, 158, 164.1, 162/134, 169

See application file for complete search history.

(56) References Cited

U.S. PATENT DOCUMENTS

| | | | | | |
|---|---|---|---|---|---|
| 2,851,741 | A | | 9/1958 | Stemples | |
| 3,879,257 | A | * | 4/1975 | Gentile et al. | 162/112 |
| 4,158,594 | A | * | 6/1979 | Becker et al. | 162/112 |
| 4,863,774 | A | | 9/1989 | Tucker | 428/77 |
| 4,977,718 | A | | 12/1990 | Hoffman, Sr. | 52/288 |
| 5,131,198 | A | * | 7/1992 | Ritchie et al. | 52/287.1 |
| 5,368,907 | A | | 11/1994 | Conboy | 428/43 |
| 5,442,886 | A | | 8/1995 | Iacobelli | 52/255 |
| 5,486,394 | A | | 1/1996 | Stough | 428/61 |
| 5,589,034 | A | * | 12/1996 | Hultman et al. | 162/111 |
| 5,613,335 | A | * | 3/1997 | Rennich et al. | 52/255 |
| 5,690,787 | A | * | 11/1997 | Hultman et al. | 162/112 |
| 5,836,122 | A | * | 11/1998 | Rennich et al. | 52/254 |
| 5,904,016 | A | | 5/1999 | Koenig et al. | 52/255 |
| 6,148,573 | A | | 11/2000 | Smythe, Jr. | 52/255 |
| 6,223,486 | B1 | | 5/2001 | Dunham | 52/255 |
| 6,295,776 | B1 | * | 10/2001 | Kunz et al. | 52/255 |
| 6,363,673 | B1 | | 4/2002 | Robertson | 52/255 |
| 6,438,914 | B1 | | 8/2002 | Robertson | 52/255 |
| 6,502,358 | B2 | | 1/2003 | Smythe, Jr. | 52/287.1 |
| 6,539,680 | B2 | * | 4/2003 | Kunz et al. | 52/256 |
| 6,543,194 | B2 | * | 4/2003 | Harel | 52/287.1 |
| 6,691,476 | B1 | * | 2/2004 | Kunz | 52/287.1 |

(Continued)

FOREIGN PATENT DOCUMENTS

| | | |
|---|---|---|
| CA | 2212854 | 8/1996 |

(Continued)

*Primary Examiner*—Jeanette Chapman
*Assistant Examiner*—Jessica Laux

(57) ABSTRACT

The present invention relates to drywall corner beads, particularly drywall corner beads having an outer paper layer, and paper therefor. The improved paperbead includes an elongated core having an outer surface. A paper strip is bonded to the outer surface of the core. The paper is impregnated on one side with a polymer, preferably latex, that penetrates only about half the thickness of the paper. The other side of the paper is roughened to improve adhesiveness to joint compounds. The latex impregnated side of the paper maintains increased strength making the paper resistant to scuffing while at the same time, the roughened side of the paper improves its adhesiveness to joint compounds.

60 Claims, 7 Drawing Sheets

U.S. PATENT DOCUMENTS

| | | | | |
|---|---|---|---|---|
| 6,722,092 | B2 * | 4/2004 | Kunz et al. | 52/255 |
| 6,770,354 | B2 * | 8/2004 | Randall et al. | 428/219 |
| 6,779,313 | B2 * | 8/2004 | Smythe, Jr. | 52/255 |
| 2001/0021733 | A1 * | 9/2001 | Peltonen et al. | 524/47 |
| 2002/0035809 | A1 | 3/2002 | Smythe | |
| 2002/0073639 | A1 * | 6/2002 | Kunz et al. | 52/255 |
| 2002/0142136 | A1 | 10/2002 | Harel | |
| 2003/0024188 | A1 * | 2/2003 | Smythe, Jr. | 52/255 |
| 2003/0033766 | A1 * | 2/2003 | Smythe, Jr. | 52/255 |
| 2003/0033770 | A1 * | 2/2003 | Harel | 52/287.1 |
| 2003/0089058 | A1 * | 5/2003 | Kunz et al. | 52/255 |
| 2003/0131546 | A1 * | 7/2003 | Kunz | 52/255 |

FOREIGN PATENT DOCUMENTS

| | | |
|---|---|---|
| GB | 2 316 104 A | 2/1998 |
| WO | WO 96/25570 | 8/1996 |
| WO | WO 96/25570 | * 10/1996 |

* cited by examiner

PAPER AND PAPERBEAD FOR PROTECTING DRYWALL CORNERS

BACKGROUND OF THE INVENTION

The present invention relates to drywall corner beads, particularly drywall corner beads having an outer paper layer, and paper therefor.

Current building construction techniques frequently call for the use of drywall sheets, otherwise called wallboard, to form the surfaces of interior walls. Sheets of drywall are made by encasing sheets of plaster with heavy construction paper. The paper provides extra strength and resistance to tearing and prevents crumbling of the enclosed plaster. The sheets of drywall are typically produced in sizes of four feet by eight feet to four feet by twelve feet. These sheets can be installed intact or can be cut to custom fit specific interior wall sizes. When cut, the inner plaster is exposed and is particularly vulnerable to crumbling or other damage unless the severed edges can be protected. An exposed corner, exterior or interior, formed by two interfacing drywall sheets not in the same plane is also susceptible to damage. Damage can be particularly severe when these corners involve cut or exposed edges. To overcome this vulnerability to injury and further reinforce the exposed corner formed by two interfacing drywall sheets, a drywall corner bead will generally be installed at that corner. The corner being reinforced can be either an interior or exterior corner.

Two types of drywall corner beads are typically used in reinforcing drywall corners, a paper faced bead or paperbead type, and a non-paper faced bead or all-metal drywall trims. Both the paperbead type and the all-metal drywall trims typically include a strip of metal formed or extruded into a desired shape, although molded plastic can also be used. One common example involves forming the metal strip into a core shape having two flanges and a center rib positioned between them. This form of corner bead is called a rib-type of corner bead. Another common type of corner bead has two flanges and a larger curved portion or bullnose positioned between them. This type of corner bead is called a bullnose corner bead. A third type of corner bead is an L-shaped type having one flange longer than the other and an offset rib between the flanges. Other types of corner beads include a J-shaped type, a splay-bead type, and a shadow-mold type.

All-metal drywall trims are attached to drywall by driving nails, screws, staples or other fasteners through the flanges, securing the drywall trim with the heads of the fasteners. A joint compound is then applied to cover the flanges and fastener heads. The compound is sanded and feathered to provide a smooth and continuous surface from the drywall surface to the center rib of the formed metal strip.

Paperbeads provide several advantages over all-metal drywall trims. For instance, both paint and joint compound adhere significantly better to the surface of a paperbead than to the exposed metal surface of a typical nail-on corner bead. Moreover, paint applied directly to a metal surface is easily chipped after drying. Drywall corners covered with nail-on corner beads are also more susceptible to cracking along the edges of the flanges. Thus, a paperbead provides a better surface for paint adhesion and helps reduce plaster cracking.

Paperbeads differ from all-metal drywall trims in several respects. First, the paperbead has a paper strip attached to an outer surface of the formed metal or plastic core previously discussed. Generally, portions of the paper strip extend beyond the edges of the metal or plastic core forming wings. The paperbead is attached to drywall corners by applying a joint compound to the drywall surface and embedding the formed metal strip and the paper wings in the compound; or it can be nailed on and then compound is applied. A second, exterior layer of joint compound is subsequently applied on top of the paperbead and allowed to dry. This exterior layer of joint compound is then sanded and feathered to form a smooth and continuous surface between the drywall and the corner bead. The steps of applying, sanding and feathering the exterior layer of joint compound can be repeated until a smooth surface is created. Throughout this process, the portion of the paper strip covering the corner bead, i.e. the center rib, the bullnose, or the offset rib, is left exposed or uncovered by joint compound.

The paper surface left exposed on a typical paperbead may be scuffed, or completely removed during the sanding and feathering process, thus exposing the metal surface beneath. Scuffing makes it more difficult to later obtain a smooth painted surface at the corner bead because the paper becomes frayed or fuzzy. Also, as stated previously, paint does not adhere as easily to the exposed metal surfaces. Therefore, paint applied to any exposed metal surface will be more easily chipped after it dries. Moreover, a scuff in the paper surface produces a break in the line of the corner bead and reduces the aesthetic benefits of having such a bead.

Joint tape made from paper strips is also used to cover the joint between two abutting sheets of drywall. The joint tape is applied to a thin layer of joint compound covering the joint, covered with an exterior layer of joint compound and sanded and feathered to form a smooth and continuous surface. As with corner beads, the joint tape can be subjected to abrasive contact that can scuff and tear the joint tape, making it difficult to obtain a smooth surface for painting.

To overcome the problems of scuffing, some paperbeads provide a surface coating at the exposed center portion of the corner bead to improve the paper's resistance to abrasion and avoid the problems caused by scuffing. This type of surface coated paperbead is disclosed in U.S. Pat. No. 5,131,198. A surface coating, however, only provides extra resistance to abrasion at the outer surface of the paper strip. If this coating is penetrated or removed by the sanding process, the underlying paper is exposed and is again made susceptible to scuffing. Consequently, the problems of paint adhesion, unsmooth surface finishes and paint chipping are not avoided. Moreover, the application of a surface coating at a particular location involves an additional manufacturing step thereby increasing the cost of making the product.

To resolve the problem of surface coated paper, U.S. Pat. Nos. 5,836,122 and 5,613,335, both to Rennich et al., propose a paperbead for protecting drywall corners containing a paper strip bonded to a metal or plastic core throughout its thickness. This paper strip is made of stack paper which is uniformly impregnated with latex which imparts scuffing and abrasion resistance to the paper.

SUMMARY OF THE INVENTION

Therefore, in view of the above, it is an object of the present invention to provide an arrangement wherein the paperbead is resistant to abrasion and has excellent adhesiveness to joint compounds.

In accordance with present invention, the improved paperbead includes an elongated core having an outer surface. A paper is bonded to the outer surface of the core. The paper is impregnated on one side with a polymer, preferably latex, that penetrates into a portion of the thickness of the paper, preferably only about half the thickness of the paper. The other side of the paper is roughened to improve adhesiveness to joint compounds. The latex impregnated side of the paper maintains increased strength making the paper resistant to scuffing, while at the same time, the roughened side of the paper improves its adhesiveness to joint compounds.

In a preferred embodiment, the paper includes a stock paper impregnated with a polymer that is cross-linked. The resulting paper is substantially stronger than papers currently used in drywall corner beads. Furthermore, the increased resistance to abrasion is a property of the paper itself, rather than just a localized shield as provided by surface coatings. Therefore, even if the surface of the paper strip is sanded away, the inner layers that are impregnated with the polymer continue to resist abrasion. A smooth surface is thus maintained as the paper strip resists scuffing. The paper strip also provides an excellent surface for paint adhesion.

The present invention also provides methods for making the paper and the paper beads.

DETAILED DESCRIPTION OF THE PRESENTLY PREFERRED EMBODIMENTS

Figure 1:
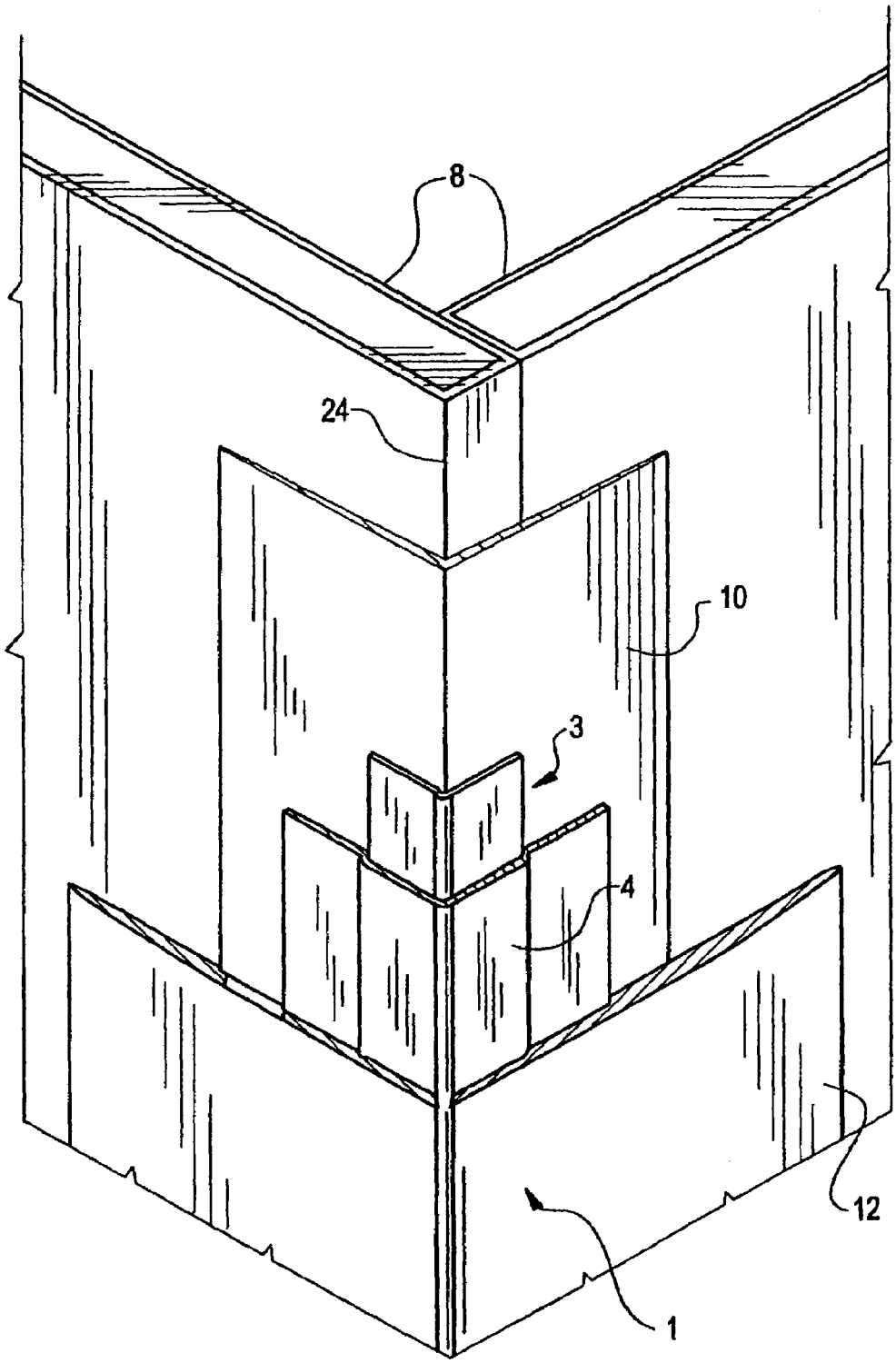
FIG. 1 is a perspective of an exterior corner with a preferred embodiment of the invention applied thereto and with portions broken away and in section.
Figure 2:
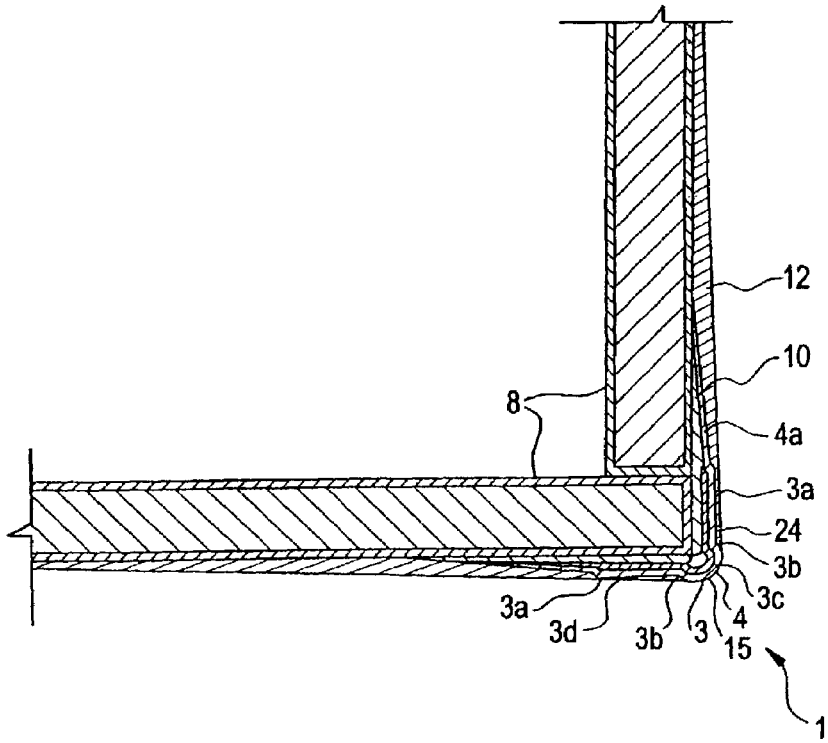
FIG. 2 is a preferred embodiment of the invention showing a cross section through an exterior corner with a rib type of paperbead applied thereto.

Referring now to the drawings in detail, and more particularly to FIGS. 1 and 2, a rib-type embodiment of the invention is illustrated. A paperbead 1 is shown covering an exposed drywall corner 24 formed by two sheets of drywall 8. The paperbead 1 has an elongated core 3 and a paper strip 4 bonded to the core as shown in FIGS. 1 and 2. The core 3 is preferably made out of galvanized steel which meets or exceeds ASTM-C1047 zinc coating specifications. However, other materials such as plastic can function as the core element. In an exemplary embodiment, the core 3 has a thickness of about 0.0125 to 0.0150 inches thickness. In the rib-type embodiment, the core 3 is roll formed into a rib shape having flanges 3*a*, a center rib 3*c* and a pair of shoulders 3*b* connecting the center rib 3*c* and the flanges 3*a*. The core 3 also has an outer surface 3*d*. The flanges 3*a* are commonly positioned at an angle of no greater than 89 degrees relative to each other, but other angular variations may be utilized to accommodate the relative positioning of the drywall sheets 8 and/or the desired shape of the corner. In the rib-type embodiment shown in FIGS. 1 and 2, the flanges 3*a* are about 1 inch wide. The center rib 3*c* is generally about 0.0625 inches high and 0.125 inches wide.

Figure 3:
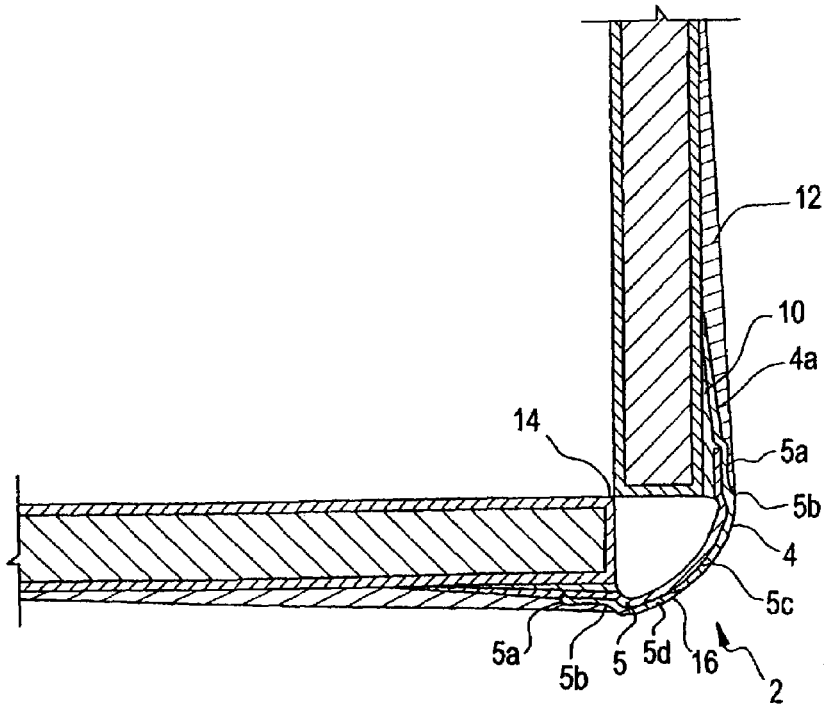
FIG. 3 is a preferred embodiment of the invention showing a cross section through an exterior corner with a bullnose type of paperbead applied thereto.
Figure 4:
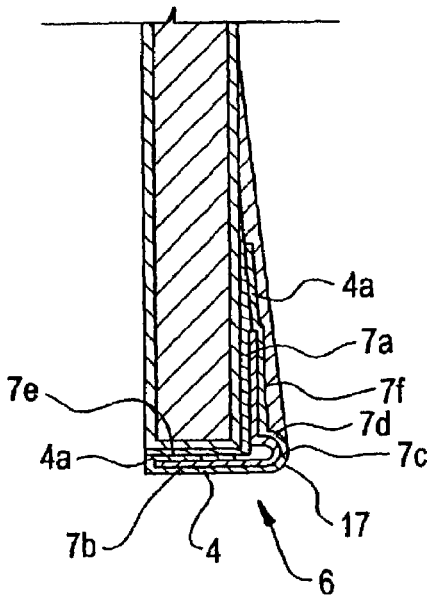
FIG. 4 is a preferred embodiment of the invention showing a cross section through a corner with a L-shaped type of paperbead applied thereto.
Figure 5:
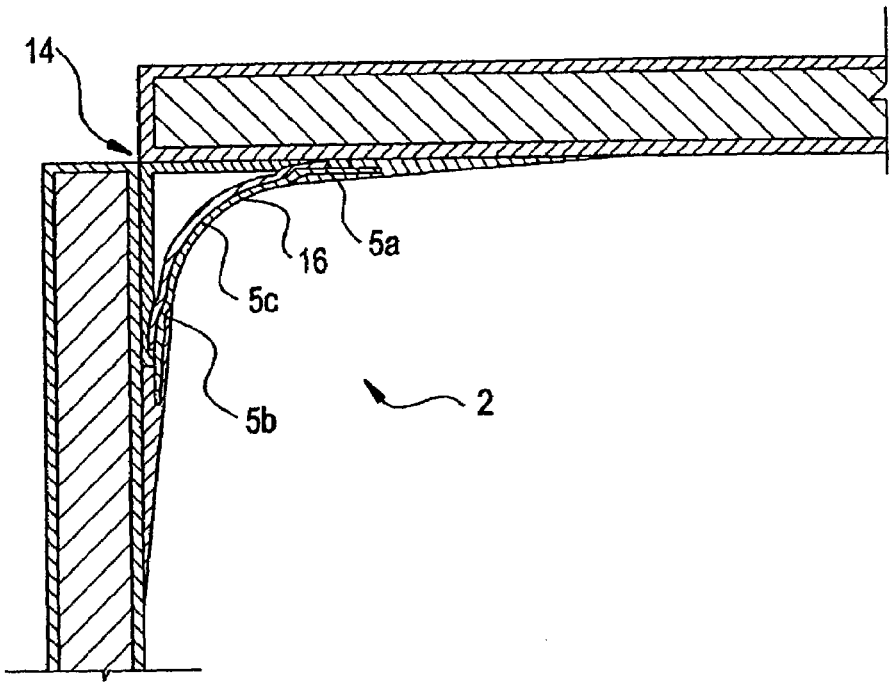
FIG. 5 is a preferred embodiment of the invention showing a cross section through an interior corner with a bullnose type of corner bead applied thereto.

The paperbead can be used to protect exterior corners, as shown in the embodiments of FIGS. 1, 2, 3 and 4, or to protect interior corners as shown in the FIG. 5 embodiment. For example, FIGS. 3 and 5 illustrate, respectively, an exterior and interior bullnose embodiment of the invention.

A bullnose paperbead 2 has a pair of flanges 5*a*, a bullnose 5*c*, a pair of shoulders 5*b* and an outer surface 5*d*. The outer surface 5*d* is defined as that surface facing away from the corner 14, independent of whether that outer surface forms a concave or a convex surface as shown in FIGS. 3 and 5. The flanges 5*a* are generally about 1 inch wide and are positioned, in this embodiment, at an angle of ninety degrees relative to one another. Other angular variations can be implemented. The radius of the bullnose 5*c* is typically in the range of about 0.5 inches to 1.5 inches. In the preferred embodiment shown, each of the shoulders 5*b* is about 0.125 inches wide and has a drop of 0.0625 from the surface of the bullnose 5*c* to the surface of the flange 5*a*.

A third embodiment of the paperbead is the L-shaped paperbead shown in FIG. 4. In this embodiment, the core 7 has a long flange 7*a*, a short flange 7*b*, an offset rib 7*c*, a shoulder 7*d* positioned between the offset rib 7*c* and the long flange 7*a*, and an outer surface 7*f*. In this embodiment, the long flange 7*a* is about 1.5 inches to 2 inches long, while the short flange 7*b* is about 0.75 inches long. The long flange 7*a* is positioned in this embodiment at no greater than 89 degrees (per ASTM-C1047) to the short flange 7*b* forming an L-shape. In an exemplary embodiment, the offset rib 7*c* is about 0.0625 inches high and about 0.125 inches wide.

Figure 7:
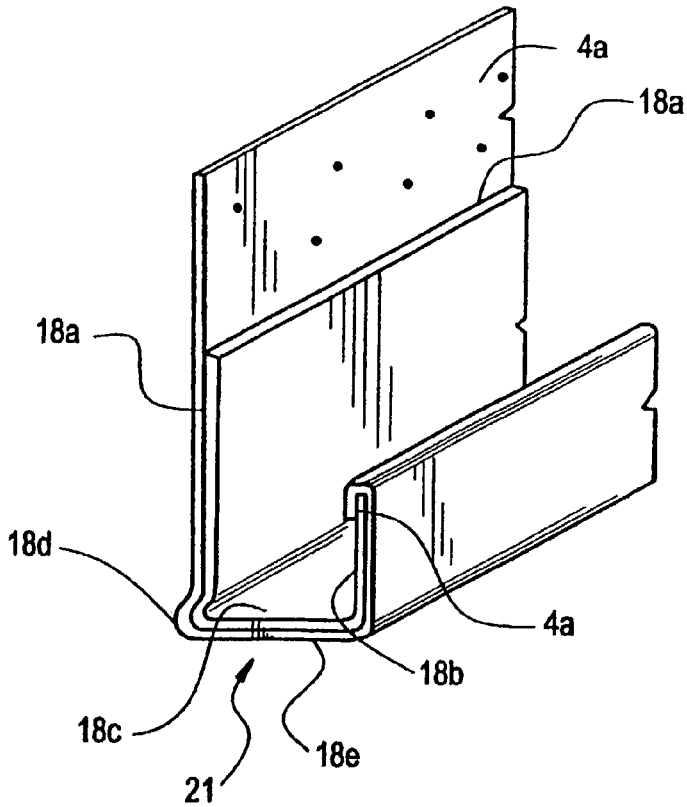
FIG. 7 is a perspective of a preferred embodiment of the invention showing a J-shaped type of paperbead.

A fourth embodiment of the paperbead is the J-shaped paperbead 21 shown in FIG. 7. In this embodiment, the core 18 has a long flange 18*a*, a short flange 18*b*, and/a center portion 18*c* positioned between the flanges. The core 18 also has an outer surface 18*d*. The long flange 18*a* is typically about 1 inch long. The short flange 18*b* is typically about ½ inches long. The center portion 18*c* is typically about ⅜ inches to ⅝ inches wide. An offset rib 18*d* is also shown in this embodiment as positioned between the center portion 18*c* and the long flange 18*a*. However, the offset rib can also be positioned between the center portion 18*c* and the short flange 18*b*, positioned between the center portion 18*c* and the short flange 18*b* and the long flange 18*a*, or excluded all together. In an exemplary embodiment, the center rib 18*d* is about 0.0625 inches high and about 0.125 inches wide.

Figure 9:
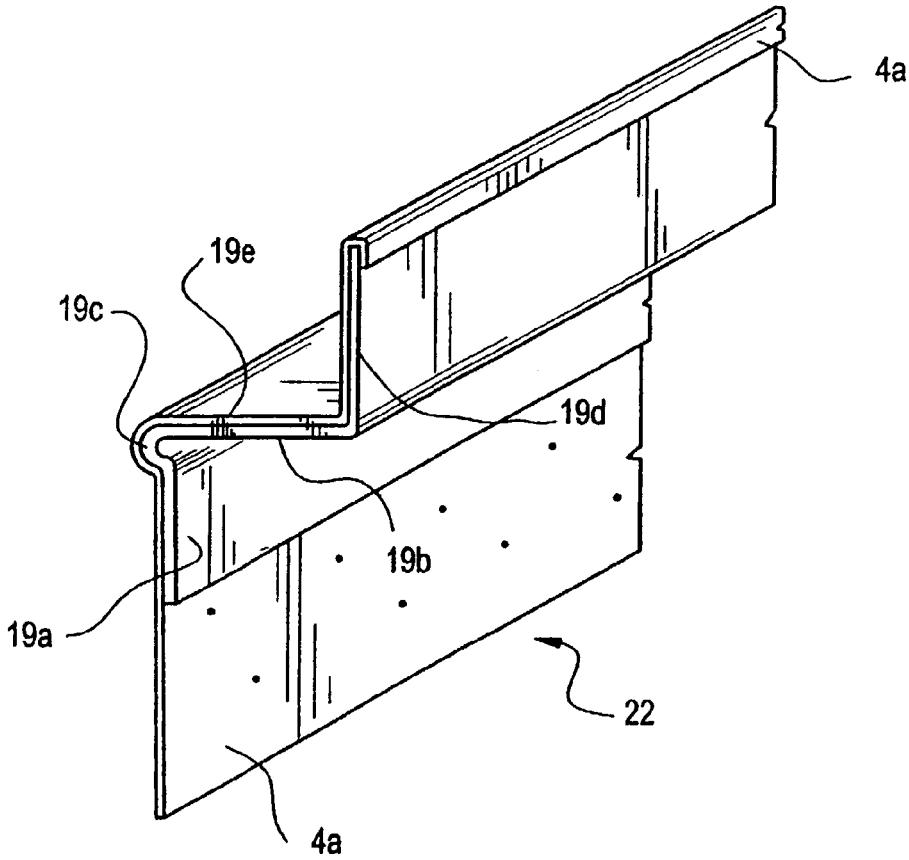
FIG. 9 is a perspective of a preferred embodiment of the invention showing a shadow-mold type of paperbead.

A fifth embodiment of the paperbead is the shadow-mold paperbead 22 shown in FIG. 9. In this embodiment, the core 19 has a first flange 19*a*, a second flange 19*d*, a center portion 19*b*, and an offset rib 19*c*. The core 19 also has an outer surface 19*e*. The first flange 19*a* extends from the offset rib 19*c* forming an angle of about 90.degree. The center portion 19*b* is positioned between the offset rib 19*c* and the second flange 19*d*. The second flange 19*d* extends from the center portion 19*b* at an angle of about 90.degree. in a direction opposite from the first flange 19*a*. In an exemplary embodiment, the flanges 19*a* and 19*d* are generally about ⅜ inches to 1 inch in length, but are not necessarily of equal length. The center portion 19*b* is about ⅜ inches to 1 inch in width.

Figure 8:
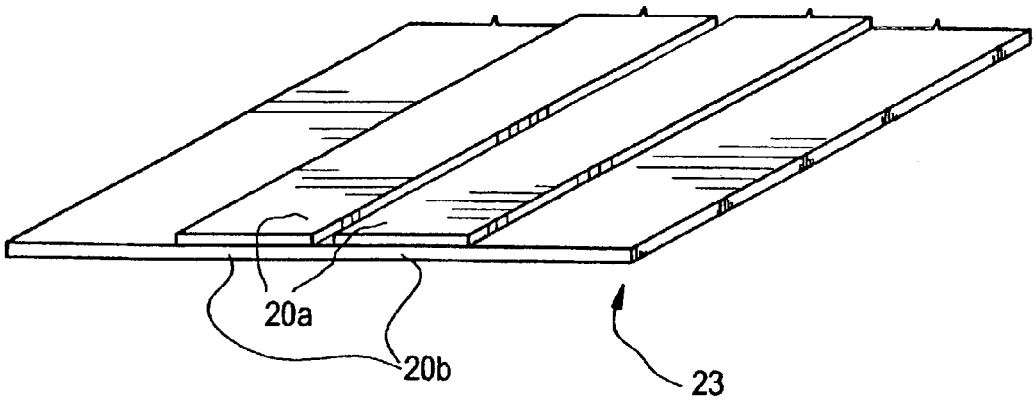
FIG. 8 is a perspective of a preferred embodiment of the invention showing a splay-bead type of paperbead.

A sixth embodiment is the splay-bead paperbead 23 shown in FIG. 8. In this embodiment, the core 20 has two strips 20*a* and an outer surface 20*b*. In an exemplary embodiment, the strips 20*a* are about ½ inches to ¾ inches in width.

Drywall paperbeads typically include the process of bonding a paper strip 4 to the outer surface 3*d* of the core element as shown in FIG. 2. In the rib-type embodiment, the paper strip 4 typically extends beyond the edge of each of the core flanges 3*a* about 1 inch to form a pair of wings 4*a*. In making the L-shaped paperbead 6, the wing 4*a* extending beyond the short flange 7*b* is wrapped around the flange and bonded to an inner surface 7*e* of the short flange 7*b*. In the splay-bead paperbead 23 embodiment of the invention, the two metal strips 20*a* are bonded to the paper strip leaving a space between them. The space may be, for example, 0.050 inches. This spacing allows the strips 20*a* to rotate relative to each other. The strips 20*a*, therefore, can be positioned at different angles relative to each other. Accordingly, the splay-bead paperbead 23 can accommodate a variety of wall angle combinations. In an exemplary embodiment, the paper strip 4 extends beyond the metal strips 20*a* about ¾ inches to 1¼ inches.

In making the J-shaped paperbead 21, the paper strip 4 can be bonded to the outer surface 18*d* of the core 18 in a number of ways. For instance, in the embodiment shown in FIG. 7, one wing 4*a* extends beyond the long flange 18*a* about ¾ inches and a second wing 4*a* wraps around the short flange 18*b* about 0.125 inches. In other J-shaped paperbead 21 embodiments, the wings 4*a* may extend beyond or wrap around the long flange 18*a* and short flange 18*c* in any number of combinations. In yet another J-shaped paperbead 21 embodiment, the paper strip 4 ends at the edge of the flanges 18*a* and 18*b*. In the shadow-mold paperbead 22 embodiment, one wing 4*a* extends beyond the first flange 19*a* about ½ inches to 1 inch. The second wing 4*a* wraps around the second flange 19*d* about 0.125 inches as shown in FIG. 9.

Figure 10:
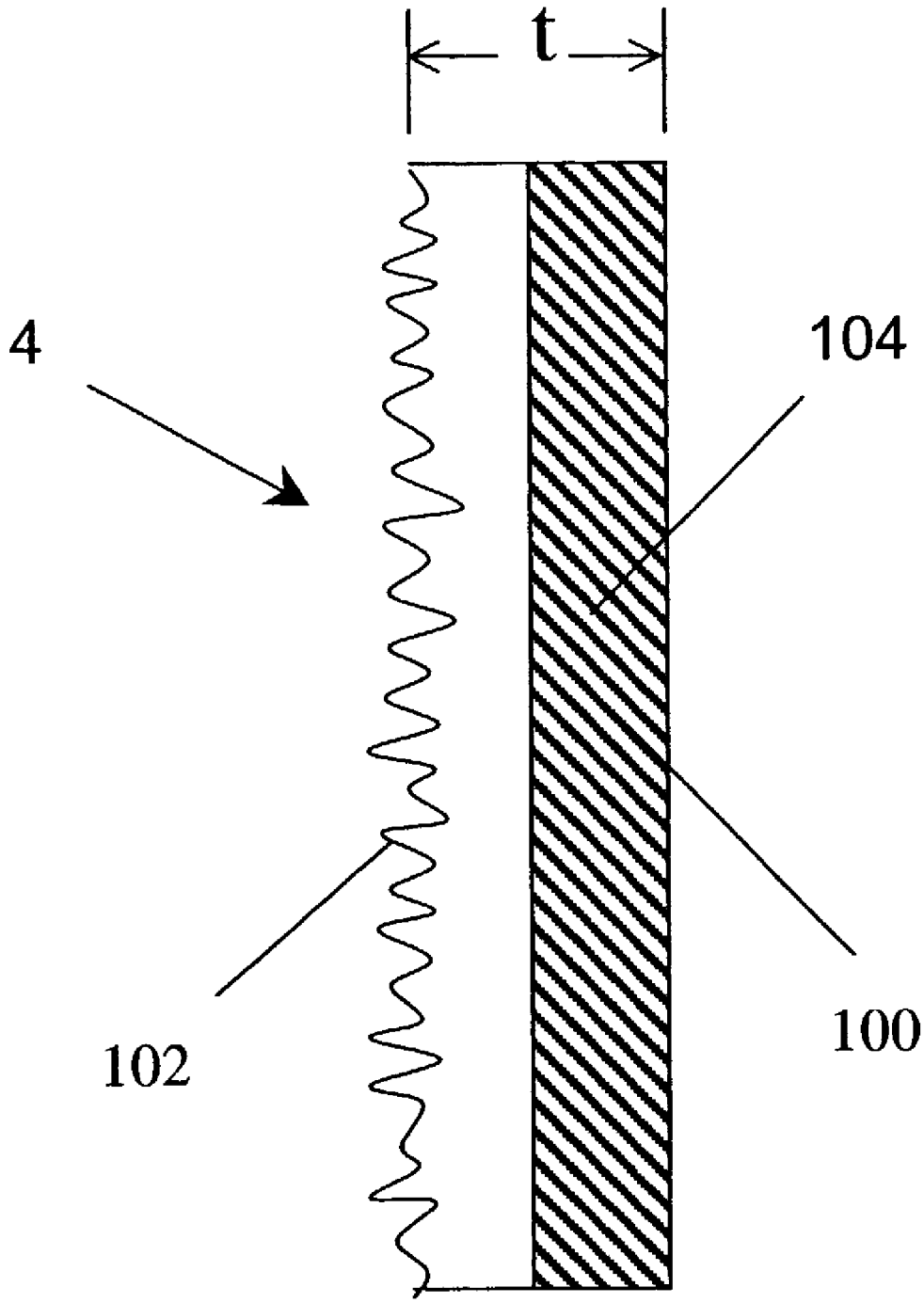
FIG. 10 is cut away view of the paper of the invention.

FIG. 10 shows the paper 4 of the present invention. The paper has two sides, a first side 100 and a second side 102. The first side 100, is impregnated with latex or other strengthening compound 104 that penetrates only about half the thickness t of the paper. The second side 102 of the paper is roughened resulting in a rough and irregular surface pattern. The paper 4 is made from a stock paper, preferably a softwood and hardwood fiber Kraft stock paper commonly used in the wall covering industry. However, synthetic fiber products can also be used. To obtain high wet and dry strength properties, the stock paper is impregnated with a polymer, preferably latex. However, other strengthening compounds may also be used to impregnate and strengthen the paper. Generally, a latex consists of a stable colloidal dispersion of a polymeric substance in an aqueous medium. There are a large number of commercial latices. For example, rubber latices, including a styrene-butadiene rubber, and resin latices, including acrylic resins, may be used to impregnate the stock paper. In a preferred embodiment, the stock paper is impregnated about 5% to 15% of strengthening compound based on the weight of the paper. The latex, however, preferably penetrates up to only about half the thickness of the paper, resulting in a paper having two different sides and surfaces.

In a preferred embodiment, the latex is cross-linked. As a result, the paper has a good internal bond and exhibits excellent Z-direction tensile strength properties. Cross-linking can be accelerated by heating or superheating the latex impregnated paper. The process of impregnating the paper and cross-linking the latex does not increase the thickness of the paper yet increases its strength properties and its ability to resist abrasion. The paper also provides an excellent surface for paint adhesion. The thickness t of the paper may be generally about 0.004 to 0.010 inches. In a preferred embodiment, the paper is about 0.005 inches in thickness.

In a preferred embodiment, the paper is composed of 100% soft wood pulp formed on a Fourdrinier paper machine. A polyamide wet strength resin is preferably added prior to forming to impart wet strength properties to the sheet. After forming, the sheet is pressed and the dried on conventional dryer cans. The paper is then impregnated with latex on the first side 100 of the paper such that the latex only penetrates half way through the thickness t of the paper. The second side 102 of the paper is roughen to obtain a felt-like texture.

Most types of metal paperbeads, exterior and interior, are produced by feeding a roll of paper and a flat metal strip into a paperbead roll former. Preferably, as the paper is being fed into the roll former, the non-impregnated surface (second side) (102) of the paper is roughened by an abrasive, granular, or metal wire surface. The metal strip is roll formed into its respective core shape, whether it be a bullnose type, a center rib type, an L-shaped type or any other type of corner bead. Metal cores can also be made by extrusion. As noted previously, plastic cores can also be utilized. In an exemplary embodiment, the paper is covered with a hot melt glue on the non-impregnated side (second side) 102. For example, several suitable fast-setting hot melt glues are commercially available. This type of glue is typically a formulated synthetic emulsion adhesive. The paper is then bonded to the outer surface of the core by applying pressure to the core and the paper with a series of pressure rolls to ensure an even bond. The paperbead is then cut to the desired length.

Figure 6:
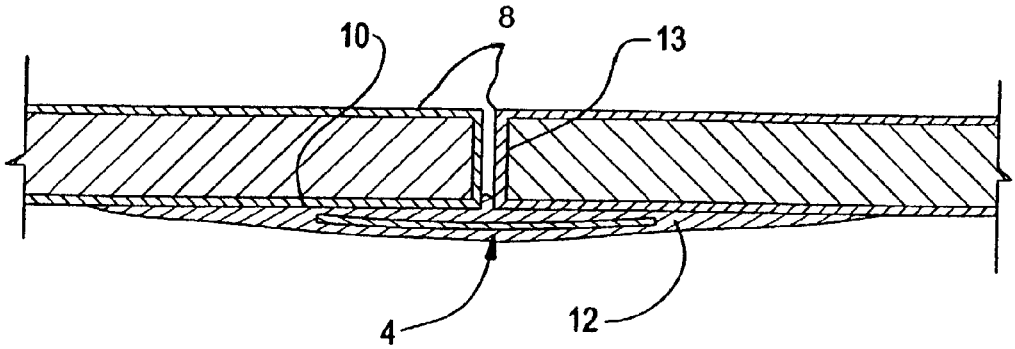
FIG. 6 is a preferred embodiment of the invention showing a cross section of two abutting sheets of drywall and a paper strip applied thereto.
Figure 11:
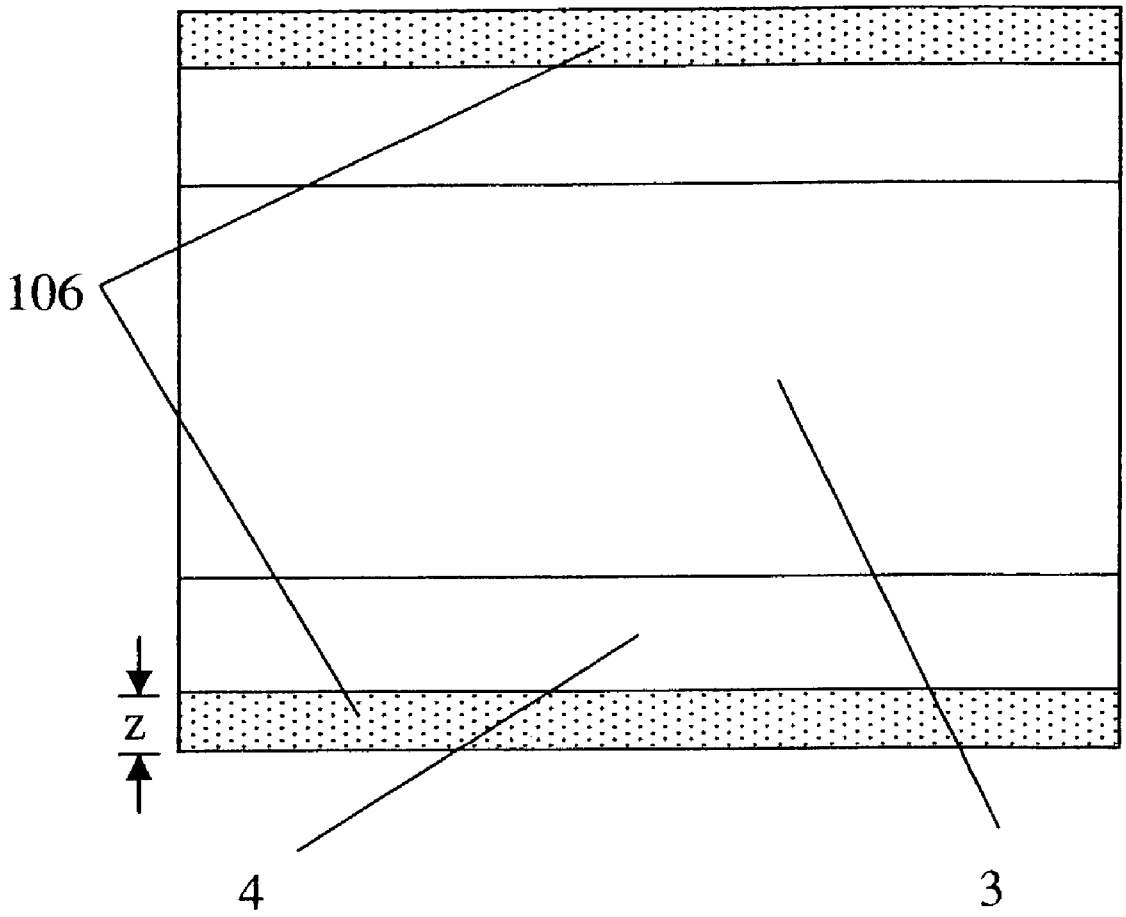
FIG. 11 is a plan view of the latex impregnated side of the paperbead of the invention.

Referring to FIG. 11, in a preferred embodiment, the latex impregnated side 100 of the paperbead has a border region 106 on the outer edges of the paper 4. The border region 106 is slightly roughened or buffed to create an uneven and irregular surface for improved bonding with compound or joint cement. The thickness z of the border region 106 is preferably about 0.5 to about 1 inch, more preferably about 0.6 to about 0.7 inch, and most preferably about 0.625 inch. The purpose of the border region 106 is to improve bonding of the paperbead with compound or joint cement to prevent edge curl when the paperbead is applied to walls. Although FIG. 11 shows a generic paperbead similar to that shown in FIG. 1, the border region 106 is also applicable to other configurations, such as the bullnose paperbead 2 (FIG. 3), L-shaped paperbead 6 (FIG. 4), J-shaped paperbead 21 (FIG. 7), shadow-mold paperbead 22 (FIG. 9), and slay-bead paperbead 23 (FIG. 8). The border region 106 is also applicable to using the paper strip 4 as a joint tape (FIG. 6).

As shown in FIGS. 1, 2, and 3, a paperbead 1, 2 is installed by first applying a thin bonding layer 10 of joint compound or joint cement of about 4 inches to 4½ inches wide to the leading edges of two interfacing drywall sheets 8. The corner beads 1, including the core 3, 5 and the paper wings 4*a* are then firmly embedded in the bonding layer 10. Excess joint compound is removed by wiping the paper strip surface with a finishing knife. An exterior layer 12 of joint compound is applied to the top of the paperbead extending about 8 inches inward on the drywall sheet 8, leaving only a paper covered center rib 15 or a paper covered bullnose 16 exposed. The exterior layer 12 of joint compound is allowed to dry and is then sanded and feathered to produce a smooth surface between the drywall sheet 8 and the paper covered center rib 15 or the paper covered bullnose 16. J-shaped paperbeads 21, shadow-mold paperbeads 22 and splay-bead paperbeads 23 are installed in a similar fashion.

The paper is well suited to prevent scuffing and other damage during this sanding and feathering process. The strength of the latex impregnated side (first side) 100 if the paper provides protection against scuffing or tearing even when the surface of the paper is penetrated or damaged. This provides improved protection over surface coated papers while avoiding the extra manufacturing step required by coating the paper. The process of adding and sanding the exterior layer 12 of joint compound can be repeated as needed to produce a smooth surface. After sanding and feathering, the paper covered center rib 15 and the paper-covered bullnose 16 remain exposed or uncovered by joint compound. The exterior layer 12 of joint compound and the exposed paper covered center rib 15 and paper-covered bullnose 16 provide an excellent surface for paint adhesion.

As shown in FIG. 5, an interior paperbead is also installed by embedding a paperbead 2 and paper wings 4*a* in a bonding layer 10 of joint compound. After drying, an exterior layer 12 of joint compound is applied, sanded and feathered. Interior bullnose paperbeads 2 will have an exposed paper covered bullnose 16. As with exterior corner beads, the paper's added strength helps resist adverse scuffing of the paper.

FIG. 4 shows a L-shaped paperbead 6 installed by applying a thin bonding layer 10 of joint compound to a drywall sheet 8 and the exposed end 8*a* of the sheet. The L-shaped paperbead 6 is embedded in the bonding layer 10. An exterior layer 12 of joint compound is then applied to cover a paper covered long flange 7*a* and wing 4*a*. This layer is sanded and feathered to provide a smooth and continuous surface between a paper covered offset rib 17 and the drywall sheet 8.

As shown in FIG. 6, a paper strip 4, made as described above, can also be used as a joint tape to cover a joint 13 formed between a pair of abutting drywall sheets 8. To cover and strengthen the joint 13, a thin bonding layer 10 of joint compound, such as joint cement or spackle, is spread about 2 inches wide on each drywall sheet 8. A paper strip 4 is applied to the bonding layer 10. An exterior layer 12 of joint compound is then applied on top of the paper strip 4. After drying, the exterior layer 12 of joint compound is sanded and feathered to provide a smooth and continuous surface between the sheets of drywall 8. This method of joining abutting sheets of drywall provides added resistance to abrasion during the sanding and feathering process, thereby avoiding a scuffed surface. In a preferred embodiment, the paper's thickness is about 0.005 inches. As other papers currently used for this application are about 0.008 inches, less joint compound is required to finish the joint. Because a thinner exterior layer 12 of joint compound is applied, the joint compound dries faster and the installation is expedited. Furthermore, less sanding and feathering is required to finish the joint.

Although the present invention has been described in detail by way of illustration and example, various changes and modifications may be made without departing in any way from the spirit of the invention and scope of the appended claims. In addition, many of the features and dimensions portrayed in the drawings have been exaggerated for the sake of illustration and clarity.

What is claimed is:

1. A paper for making drywall paperbead comprising a first side and a second side, said first side is impregnated with a polymer strengthening compound penetrating into only a portion of the thickness of the paper, and said second side is roughened.

2. The paper of claim 1, wherein the strengthening compound penetrates only up to about half the thickness of the paper.

3. The paper of claim 1, wherein the polymer strengthening compound is latex.

4. The paper of claim 3, wherein the latex is cross-linked.

5. The paper of claim 1, wherein said second side is roughened by mechanical means.

6. The paper of claim 1, wherein the polymer strengthening compound comprises an acrylic resin.

7. The paper of claim 6, wherein the acrylic resin is cross-linked.

8. The paper of claim 1, wherein said paper is 0.004 to 0.10 inches thick.

9. The paper of claim 1,, wherein said first side has a border region that is lightly roughened or buffed.

10. The paper of claim 9, wherein the border region is about 0.5 to about 1 inch from the edge of the paper.

11. The paper of claim 9, wherein the border region is about 0.625 inch from the edge of the paper.

12. A drywall paperbead comprising a core having an outer surface; and the paper of claim 1, wherein the first side of the paper is bonded to the outer surface of said core.

13. The drywall paperbead of claim 12, wherein the polymer strengthening compound penetrates only up to about half the thickness of the paper.

14. The drywall paperbead of claim 12, wherein the polymer strengthening compound is latex.

15. The drywall paperbead of claim 14, wherein the latex is cross-linked.

16. The drywall paperbead of claim 12, wherein said second side is roughened by mechanical means.

17. The drywall paperbead of claim 12, wherein the polymer strengthening compound comprises an acrylic resin.

18. The drywall paperbead of claim 17, wherein the acrylic resin is cross-linked.

19. The drywall paperbead of claim 12, wherein said paper is 0.004 to 0.10 inches thick.

20. The drywall paperbead of claim 12, wherein said core has a pair of flanges, said paper extends beyond said flanges to form a pair of wings.

21. The drywall paperbead of claim 20, wherein said core further comprises a center rib and two shoulders interposed between said flanges, said shoulders connecting said center rib and said flanges.

22. The drywall paperbead of claim 20, wherein said core further comprises a bullnose and a pair of shoulders interposed between said flanges, said shoulders connecting said bullnose to said flanges.

23. The drywall paperbead of claim 20, wherein said core further comprises a shoulder and an offset rib, said flanges comprising a long flange and a short flange, said short flange having an inner surface, said shoulder connecting said long flange and said offset rib, said wing extending beyond said short flange bonded to said inner surface of said short flange.

24. The drywall paperbead of claim 12, wherein said core further comprises a center portion, an offset rib, a first flange and a second flange, said center portion positioned between said offset rib and said second flange, said second flange extending from said center portion, said first flange extending from said offset rib in a direction opposite said second flange.

25. The drywall paperbead of claim 12, wherein said core further comprises a center portion, a short flange and a long flange, said center portion positioned between said long flange and said short flange to form a J-shape.

26. The drywall paperbead of claim 12, wherein said core further comprises two strips, said strips positioned so as to form a space between them.

27. The drywall paperbead of claim 12, further comprising a formulated synthetic emulsion adhesive bonding said paper strip to said core.

28. The drywall paperbead of claim 12, wherein said first side has a border region that is lightly roughened or buffed.

29. The drywall paperbead of claim 28, wherein the border region is about 0.5 to about 1 inch front the edge of the paper.

30. The drywall paperbead of claim 28, wherein the border region is about 0.625 inch from the edge of the paper.

31. A method for making paper for drywall paperbead, said method comprising providing a sheet of paper having a first side and a second side; impregnating a polymer strengthening compound on the first side such that the strengthening compound penetrates into only a portion of the thickness of the paper; and roughening the second side.

32. The method of claim 31, wherein the polymer strengthening compound penetrates only up to about half the thickness of the paper.

33. The method of claim 31, wherein the polymer strengthening compound is latex.

34. The method of claim 33, wherein the latex is cross-linked.

35. The method of claim 31, wherein said second side is roughened by mechanical means.

36. The method of claim 31, wherein the polymer strengthening compound comprises an acrylic resin.

37. The method of claim 36, wherein the acrylic resin is cross-linked.

38. The method of claim 31, wherein said paper is 0.004 to 0.10 inches thick.

39. The method of claim 31, wherein said first side has a border region that is lightly roughened or buffed.

40. The method of claim 39, wherein the border region is about 0.5 to about 1 inch from the edge of the paper.

41. The method of claim 39, wherein the border region is about 0.625 inch from the edge of the paper.

42. A method for making drywall paperbead, said method comprising providing a core having an outer surface; providing the paper of claim 1; and bonding the outer surface of the core to the first side of the paper.

43. The method of claim 42, wherein the polymer strengthening compound penetrates only up to about half the thickness of the paper.

44. The method of claim 42, wherein the polymer strengthening compound is latex.

45. The method of claim 44, wherein the latex is cross-linked.

46. The method of claim 42, wherein said second side is roughened by mechanical means.

47. The method of claim 42, wherein the polymer strengthening compound comprises an acrylic resin.

48. The method of claim 47, wherein the acrylic resin is cross-linked.

49. The method of claim 42, wherein said paper is 0.004 to 0.10 inches thick.

50. The method of claim 42, wherein said core has a pair of flanges, said paper extends beyond said flanges to form a pair of wings.

51. The method of claim 50, wherein said core further comprises a center rib and two shoulders interposed between said flanges, said shoulders connecting said center rib and said flanges.

52. The method of claim 50, wherein said core further comprises a bullnose and a pair of shoulders interposed between said flanges, said shoulders connecting said bullnose to said flanges.

53. The method of claim 50, wherein said core further comprises a shoulder and an offset rib, said flanges comprising a long flange and a short flange, said short flange having an inner surface, said shoulder connecting said long flange and said offset rib, said wing extending beyond said short flange bonded to said inner surface of said short flange.

54. The method of claim 42, wherein said core further comprises a center portion, an offset rib, a first flange and a second flange, said center portion positioned between said offset rib and said second flange, said second flange extending from said center portion, said first flange extending from said offset rib in a direction opposite said second flange.

55. The method of claim 42, wherein said core further comprises a center portion, a short flange and a long flange, said center portion positioned between said long flange and said short flange to form a J-shape.

56. The method of claim 42, wherein said core further comprises two strips, said strips positioned so as to form a space between them.

57. The method of claim 42, further comprising a formulated synthetic emulsion adhesive bonding said paper strip to said core.

58. The method of claim 42, wherein said first side has a border region that is lightly roughened or buffed.

59. The method of claim 58, wherein the border region is about 0.5 to about 1 inch from the edge of the paper.

60. The method of claim 58, wherein the border region is about 0.625 inch from the edge of the paper.

* * * * *